US006279299B1

(12) United States Patent
Lee

(10) Patent No.: US 6,279,299 B1
(45) Date of Patent: Aug. 28, 2001

(54) FILE BLOCK AND METHOD OF USING SAME

(76) Inventor: Kevin L. Lee, 2049 Thayer Ave., Los Angeles, CA (US) 90025

( * ) Notice: Subject to any disclaimer, the term of this patent is extended or adjusted under 35 U.S.C. 154(b) by 0 days.

(21) Appl. No.: 09/141,863

(22) Filed: Aug. 28, 1998

(51) Int. Cl.[7] ..... B65B 61/20

(52) U.S. Cl. ..... 53/445; 53/474; 53/542; 53/157; 211/51; 211/59.4; 220/529; 220/534; 220/559; 312/183

(58) Field of Search ..... 53/445, 472, 473, 53/474, 139.5, 156, 542, 157; 220/530, 534, 529, 559; 211/50, 51, 59.4, 184; 312/183, 190

(56) References Cited

U.S. PATENT DOCUMENTS

| | | | | |
|---|---|---|---|---|
| 993,881 | * | 5/1911 | Rudolph | 220/559 |
| 1,121,151 | * | 12/1914 | Ulrich | 312/190 |
| 1,675,269 | * | 6/1928 | Hine | 211/184 |
| 2,248,396 | * | 7/1941 | Terry | 211/50 |
| 3,269,392 | * | 8/1966 | McLain | 220/529 |
| 3,495,374 | * | 2/1970 | Ebbers et al. | 53/445 |
| 3,564,811 | * | 2/1971 | Freeman | 53/472 |
| 3,632,013 | | 1/1972 | Rothenberg et al. . | |
| 3,746,296 | * | 7/1973 | Dean . | |
| 3,785,520 | * | 1/1974 | Spees | 220/534 |
| 3,814,490 | | 6/1974 | Dean et al. . | |
| 3,844,415 | | 10/1974 | Heimann . | |
| 4,067,630 | | 1/1978 | Stark et al. . | |
| 4,102,470 | | 7/1978 | Timmons . | |
| 4,782,960 | | 11/1988 | Mavrakis . | |
| 4,820,001 | * | 4/1989 | Paul | 312/183 |
| 4,836,390 | * | 6/1989 | Polvere | 211/51 |
| 4,838,436 | | 6/1989 | Bailey . | |
| 4,884,692 | * | 12/1989 | Middlebrooks | 53/472 |
| 5,111,959 | | 5/1992 | Glickman . | |

* cited by examiner

*Primary Examiner*—Stephen F. Gerrity
(74) *Attorney, Agent, or Firm*—Stetina Brunda Garred & Brucker

(57) ABSTRACT

A file block or a drawer filler for supporting file folders, envelopes, and the like within file drawers or containers. The file block has a rectangular structure with six rectangular walls. At least one wall resiliently extends outward, which creates pressure against file folders and the like to be supported. Also disclosed is a blank for the file block, from which the file block is easily assembled.

32 Claims, 12 Drawing Sheets

FILE BLOCK AND METHOD OF USING SAME

FIELD OF THE INVENTION

The present invention generally relates to a device for supporting file folders within a storage container, a blank for making the device and a method of using the device.

BACKGROUND OF THE INVENTION

File folders and the like are commonly stored in a storage container, such as a file drawer, a storage bin, or a storage box. In organizing or managing the file folders within such a storage container, the optimal resting position of the file folders for easy access and retrieval is vertical. File folders positioned vertically without proper support will eventually slide or topple down, thus making access and retrieval difficult. File supporters are used to maintain the file folders vertical within the file container.

The vertical file supporters are typically installed in a file drawer by having an engaging member on the support latch on a rail along the bottom of the drawer or fit into notches in the bottom of the drawer. Generally, these types of file folder supporters have many parts for installation. As a result, their constructions are complicated, which increases the cost. Further, the installation of these file supporters to the drawer or container is inconvenient, and adjustment or movement of the file supporter is difficult and time consuming.

A type of file supporters which hangs file folders generally creates a wasted space under the bottom of the file folders hung within a file drawer or container. Further, index tabs of the file folders, which are located at the upper tip of the folder, are often damaged due to rubbing against the ceiling or top panel while the drawer or container is opened or closed.

Therefore, a need exists for a file supporter which is simple in structure, and thus easy to make and less expensive than the existing file supporters. Further, a need exists to use the space within a file drawer or container and to avoid the damage of the index tabs of the file folders.

SUMMARY OF THE INVENTION

The aforementioned needs are satisfied by several aspects of the present invention. In accordance with one aspect of the present invention, a device for supporting file folders is provided. The device comprises a substantially rectangular box with six substantially rectangular walls. Advantageously, the walls have no opening or perforation thereon. At least one of the walls of the rectangular box is configured to curve resiliently outward so that each curved wall creates pressure against the objects supported thereby. One or more boxes can be placed in the file drawer, oriented as needed to fill the spaces between the end of the drawer and the files, advantageously with the resilient wall urging the files together.

Another aspect of the present invention provides a blank for making a file block, which comprises a substantially rectangular box. The blank comprises six substantially rectangular wall portion defined by edges having a length or a width. Each of the wall portions does not have any opening or perforation thereon. The six wall portions are configured to form six walls of the rectangular box. At least one of the six wall portions is in either the length or the width thereof longer than those of corresponding wall portions so that the wall formed from the at least one wall portion having the longer length or width curves outward when the device is assembled from the blank.

There is thus advantageously provided an apparatus for supporting objects in a storage container. The apparatus has at least one hexahedral box having six substantially quadrilateral walls. At least one of the walls is configured to extend resiliently outward to resiliently contact an object in the storage container that is abutting the resilient wall. Advantageously the longest wall is sized to fit within a storage container. Preferably, the longest wall is shorter than the shortest major dimension of the storage container. Usually, the longest wall is shorter than the width of the storage container. Advantageously, each wall does not have any opening or perforation thereon. Desirably, at least one of the walls is resiliently urged outward. One way to achieve this is by having the outwardly urged wall be longer than the surrounding walls so as to cause the longer wall bow outward.

Another aspect of this invention comprises a kit for use in storing things in a storage container of predetermined size. The kit includes at least one blank of material configured to be formed into one or two, or even more boxes. The kit could include the formed or assembled boxes, but preferably includes the unassembled sheets of material. The boxes preferably comprise a hexahedral box having six substantially quadrilateral walls, and more preferably at least one of the walls is configured to extend resiliently outward to resiliently contact an object abutting the resilient wall. Preferably at least one of the boxes has a trapezoidal shape. Further, both boxes are preferably sized so they both fit within the storage container. Advantageously, the boxes are sized so the longest dimension is smaller than the shortest dimension of the storage container, although other dimensions are possible. Ideally, the kit includes one or more rectangular boxes and at least one trapezoidal box.

There is also provided a method for supporting objects in a walled storage container where the container has a predetermined length, width and height. This support is achieved by placing at least one file block in the container and positioning the file block so that the file block has a first surface abutting the object and an opposing surface abutting a supporting surface comprising one wall of the container or another object in the container. Advantageously, at least one file block has six substantially quadrilateral walls. The file blocks can be of different shape, but are advantageously rectangular in shape with the longest wall being shorter than the width of the container. The file blocks are preferably selected to have at least one file block with an inclined wall relative to an opposing wall. This inclined wall helps orientate files in the container. Further, you can place at least two file blocks in the container and select one of the file blocks to have an inclined wall relative to an opposing wall. The file blocks can be placed in various orientations to occupy a wide variation of space and provide support over a wide variety of distances. The file blocks can also be inserted among various files to help position and orientate them.

These and other features of the present invention will become more fully apparent from the following description and claims.

BRIEF DESCRIPTION OF THE DRAWINGS

These and other features of the invention will now be described with reference to the drawings of embodiments, which is intended to illustrate and not to limit the invention, and in which like numerals refer to like parts throughout the description.

DETAILED DESCRIPTION OF THE EMBODIMENT

Figure 1:
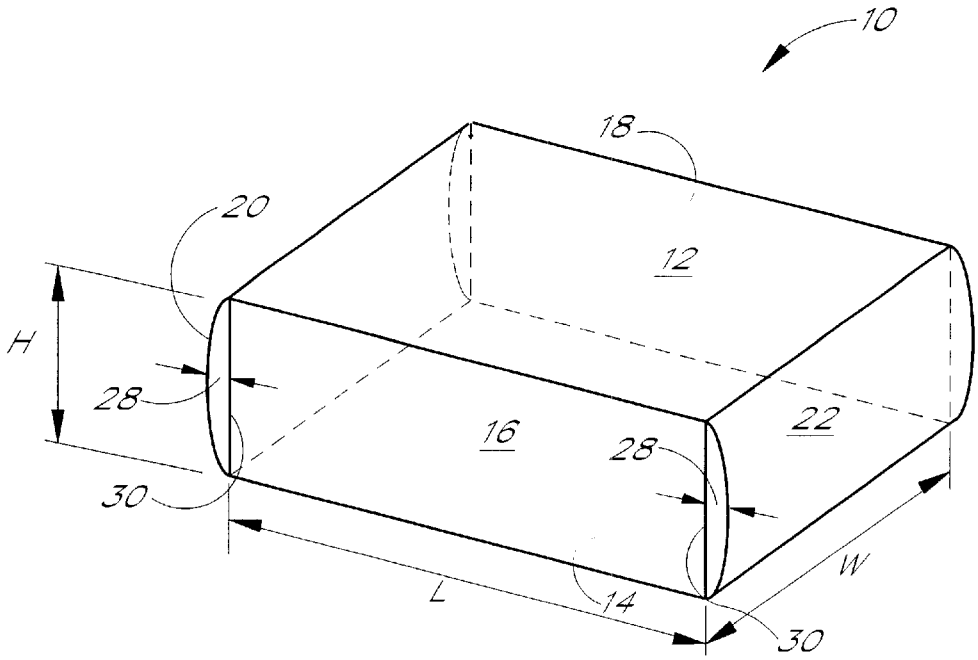
FIG. 1 shows a perspective view of a file block in accordance with one embodiment of the present invention.

Referring to FIG. 1, a file block 10 advantageously forms a substantially rectangular box, which includes six substantially rectangular walls. The six rectangular walls are referred to as top wall 12, bottom wall 14, front sidewall 16, rear sidewall 18, left sidewall 20, and right sidewall 22. As used herein, left, right, top, bottom, front and rear refer to the relative position as shown in the particular drawing referred to. In the illustrated file block 10, the two opposingly located walls are interchangeable in their name with each other. Thus, top and bottom walls 12, 14 are opposite to each other, and in generally parallel planes.

Advantageously, none of the six rectangular walls 12, 14, 16, 18, 20, 22 includes any opening or perforation thereon, which may affect structural rigidity and the resiliency of the box 10 or of one single wall of the box 10.

The left and right sidewalls 20, 22 advantageously form outwardly expanded curved surfaces in the illustrated file block 10. The curved walls 20, 22 serve as a spring, which creates and maintains a slight pressure against abutting objects. This feature of the file block 10 facilitates movement, access, and/or retrieval of file folders and the like supported by the curved walls 20, 22. The outwardly curved surface can be provided to at least one sidewall of the box 10. Advantageously, the outwardly curved surface is provided to at least one pair of opposingly located walls such as walls 20, 22 to enable the file folder 10 to retain a higher pressure along an axis through the opposingly located walls 20, 22.

The curved surface is defined by a span 28, which is the largest outward gap between each curved wall 20, 22 and the neighboring edge 30 otherwise contacting the curved wall 20, 22. The span 28 varies with the size and material of the file block 10 as well as possible objects to be supported. However, the largest span 28 is advantageously about 0.05 to about 1.0 inches, desirably about 0.1 to about 0.5 inches, and preferably about 0.25 inches.

The file block 10 is designed to support objects in connection with storage devices, such as file cabinets, file drawers, storage bins, storage boxes, file caddies, bookcases, bookshelves, etc. The objects that the file block 10 is to support include file folders, index card, envelopes, brochures, catalogs, magazines, books, etc.

Although not illustrated, advantageously adhesive may be applied to a part of at least one wall of the file block 10, so that the file block is secured or maintained to a specific position within a file drawer or a storage container. The adhesive is desirably applied to one to three walls of the file block 10, depending upon the position of the file block 10 within the drawer or container. Advantageously, two-side adhesive tape is used in providing the adhesive on the walls. The two-side adhesive tape is desirably provided on every wall of the file block.

The file block 10 is made of a suitable material for supporting the objects, such as paperboard, cardboard, corrugated paper, plastic, metal, etc. Advantageously, the file block 10 is made of a paper material, which is generally less expensive and has better workability than other materials. Thickness of the material is determined with the consideration of the structural strength of the box 10. For example, when paperboard is used as a material, it is advantageously thicker than about 0.025 inches, and preferably at least 0.028 inches thick.

The size of the file block 10 can be varied. The size of each wall can also be varied by changing any one or two of the length L, width W, and height H. Thus the shape of the rectangular box 10 can be changed. The size and the shape of the file block 10 are advantageously selected, depending on the size and/or the shape of the objects to be supported.

For letter sized file folders suspended in correspondingly sized containers or file drawers, for example, the length L is about advantageously 8–9 inches, but not longer than 11.75 inches, which is the length of the letter sized file folder. The length L is preferably about 10 inches. The width W is at least about 2.0 inches and longer than the height H, and preferably about 6.0 inches. The height H is at least about 2.0 inches and advantageously shorter than the width W, and preferably about 3.5 inches.

Figure 2A:
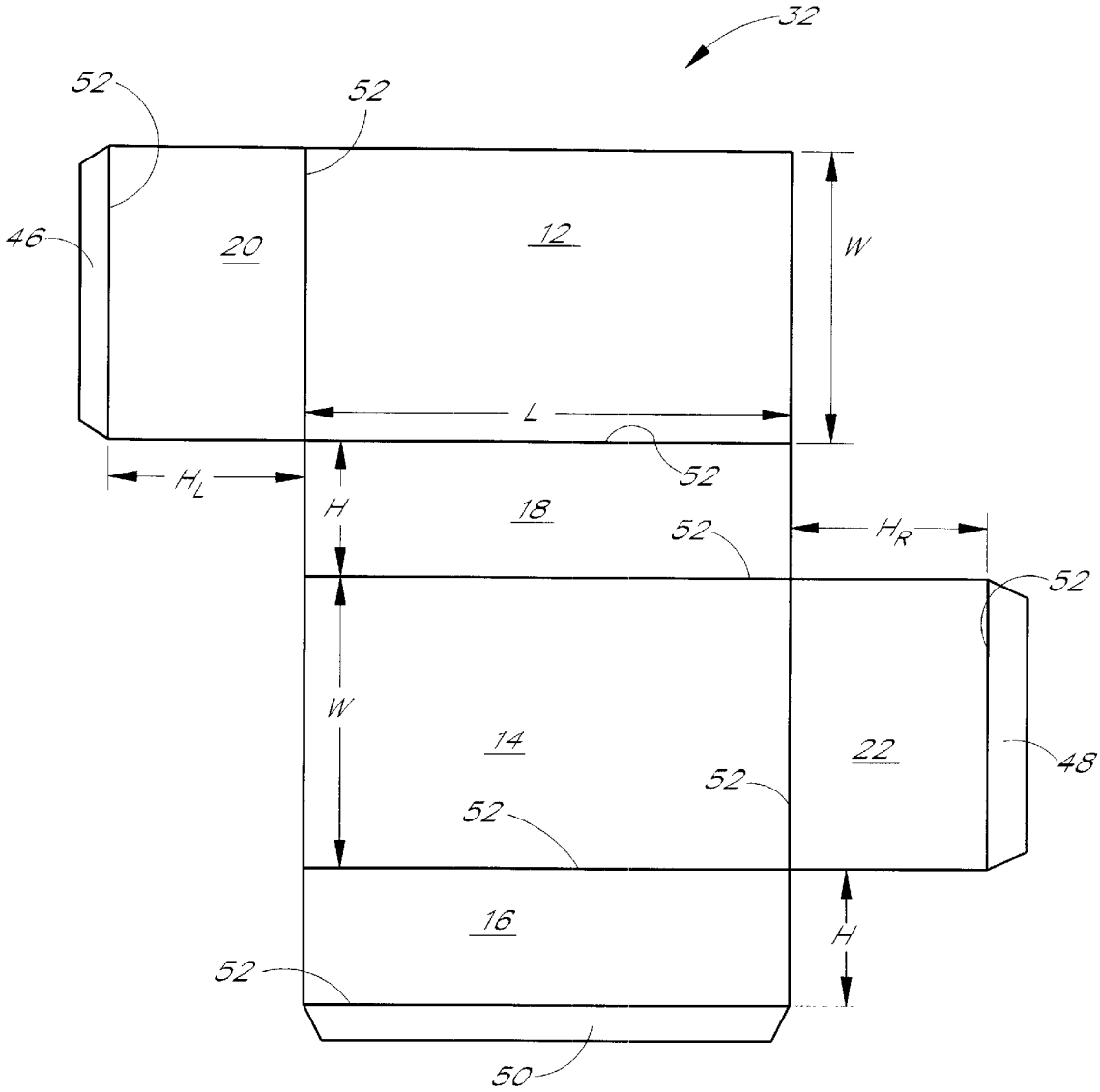
FIGS. 2A and 2B show embodiments of a blank for the file block shown in FIG. 1.

FIG. 2A shows an embodiment of a blank 32 for the file block 10, which is also an exploded view of the file block 10 shown in FIG. 1. The file block blank 32 generally includes six rectangular wall portions, each of which forms a wall of the file block when assembled. As noted above in connection with the file block 10, the wall portions are referred to as top wall portion 12, bottom wall portion 14, front sidewall portion 16, rear sidewall portion 18, left sidewall portion 20, and right sidewall portion 22 for the description purpose. Likewise, wall portions for two opposingly located walls, when assembled, are interchangeable in their name and location with each other. For example, the left sidewall portion 20 may extend from the left edge of the bottom wall portion 14, and the right sidewall portion 22 may also extend from the right edge of the top wall portion 12.

Flanges 46, 48, 50 are provided respectively along the left edge of the left sidewall portion 20, the right edge of the right sidewall portion 22, and the lower edge of the front sidewall portion 16. Alternatively, the flanges 46, 48, 50 may be provided respectively along the left edge of the bottom wall portion 14, the right edge of the top wall portion 12, and the upper edge of the top wall portion 12.

Every border of neighboring walls and flanges forms a folding line 52, along which the two neighboring walls are folded until they have substantially perpendicular relationship to each other when the blank 32 is assembled. When each of the wall portions 12, 14, 16, 18, 20, 22 and the flanges 46, 48, 50 are folded along the folding lines 52, the flange 48 overlaps an area of the bottom wall portion 14, and the flanges 50, 52 also overlap areas of the top wall portion 12. Each flange 46, 48, 50 is to be attached to the corresponding overlapped areas of the wall portions 14, 12 with adhesive, staplers, interlocking connections, or other means to form substantially rectangular file block 10, as shown in FIG. 1. The shape and size of the flanges 46, 48, 50 can be varied. More than one flange can be provided along each edge from which each flange 46, 48, 50 depends.

The lateral length $H_L$ of the left sidewall portion 20 is advantageously larger than the vertical length H of the rear and front sidewall portions 12, 14, which is height H of the file block 10 when assembled. Likewise, the lateral length $H_R$ of right sidewall portion 22 is advantageously larger than the vertical length H of the rear and front sidewall portions 12, 14. With these configurations, the left and right sidewalls 20, 22 of the assembled file block 10 are curved outward, as shown in FIG. 1. The lateral height of the side wall portion 22 cannot be too much longer than the height of the side wall portions 12, 14, because that will tend to tear to side walls. Further, even if the lateral lengths $H_L$, $H_R$ are not greater than the vertical length H they will still bow outward slightly. Even with the almost identical lateral and vertical lengths, the left and right side wall 20, 22 have natural tendency to resiliently urge outward when assembled.

Figure 2B:
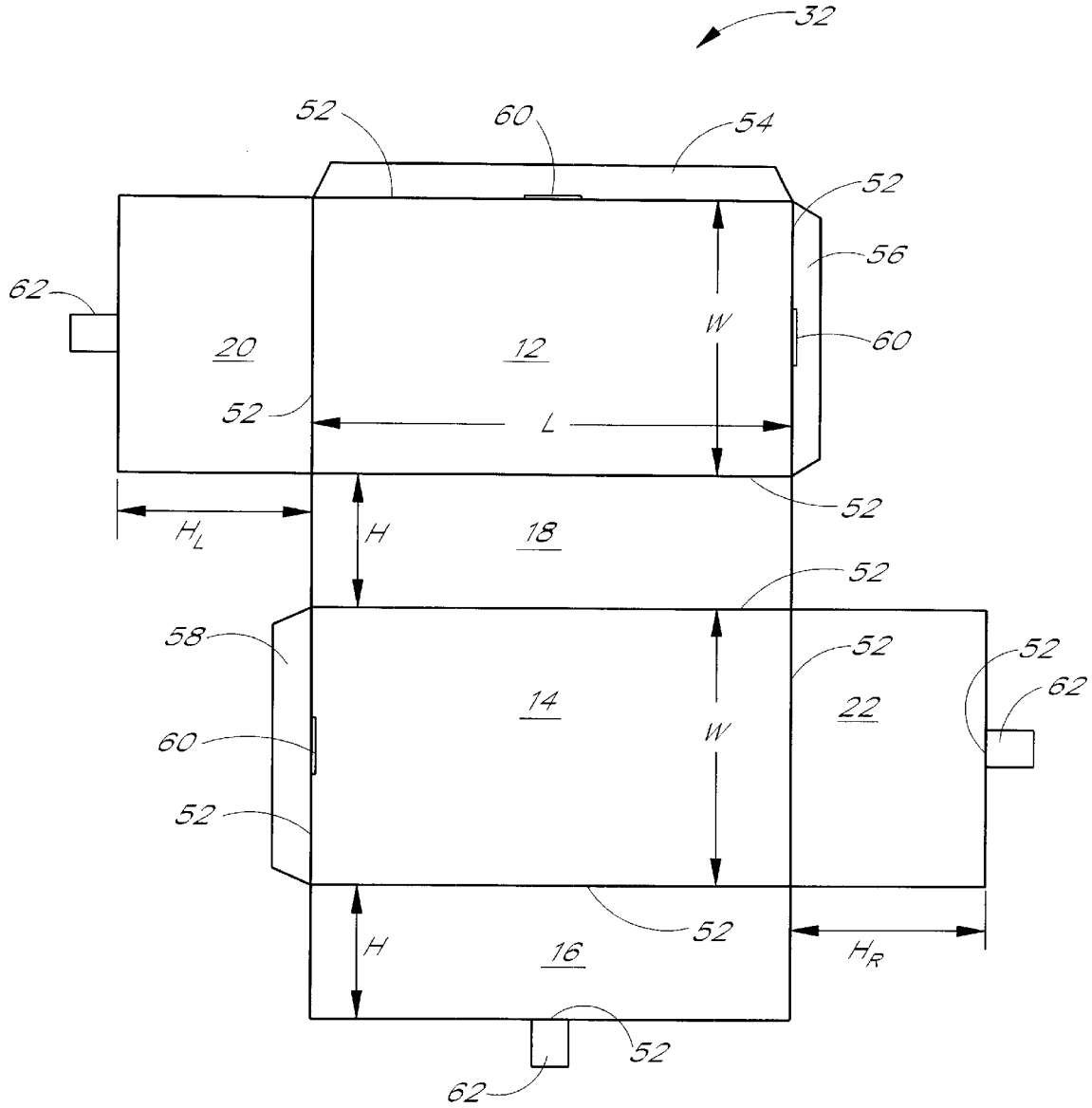

FIG. 2B shows another embodiment of the file block blank 32, which also represents an exploded view of the file block 10 of FIG. 1. Like elements are referred by like numerals, and the description of like components between the embodiments should be understood to apply to the present embodiment unless indicated otherwise.

In the illustrated embodiment, flanges 54, 56, 58 extend respectively from the upper and right edges of the top wall portion 12 and the left edge of the bottom wall portion 14. A slit 60 is provided on the border 52 between each flange 54, 56, 58 and the wall 12, 14 from which the flange 54, 56, 58 depends. Also, a protruding portion 62 is provided on each edge of the walls an area of which overlaps with each flange when each of the wall portions 12, 14, 16, 18, 20, 22 and the flanges 54, 56, 58 is folded along the folding lines 52. Each protruding portion 62 is inserted into and secured to the corresponding slit 60 so that the blank 32 can be assembled to the file block 10 without using any adhesive, staples, interlocking parts, or other means. Wall portions and flanges which are opposingly located to each other may be interchangeable in their location. For example, the left sidewall portion 20 may extend from the left edge of the bottom wall portion 14, and the flange 58 instead extends from the left edge of the top wall portion 12.

The shape and size of the flanges 54, 56, 58 can be varied. Also, the size and shape of the protruding portions 62 can be varied along with the size of the corresponding slits 60. More than one protrusion 62 can be provided to each edge with the same number of corresponding slits 60.

Figure 3A:
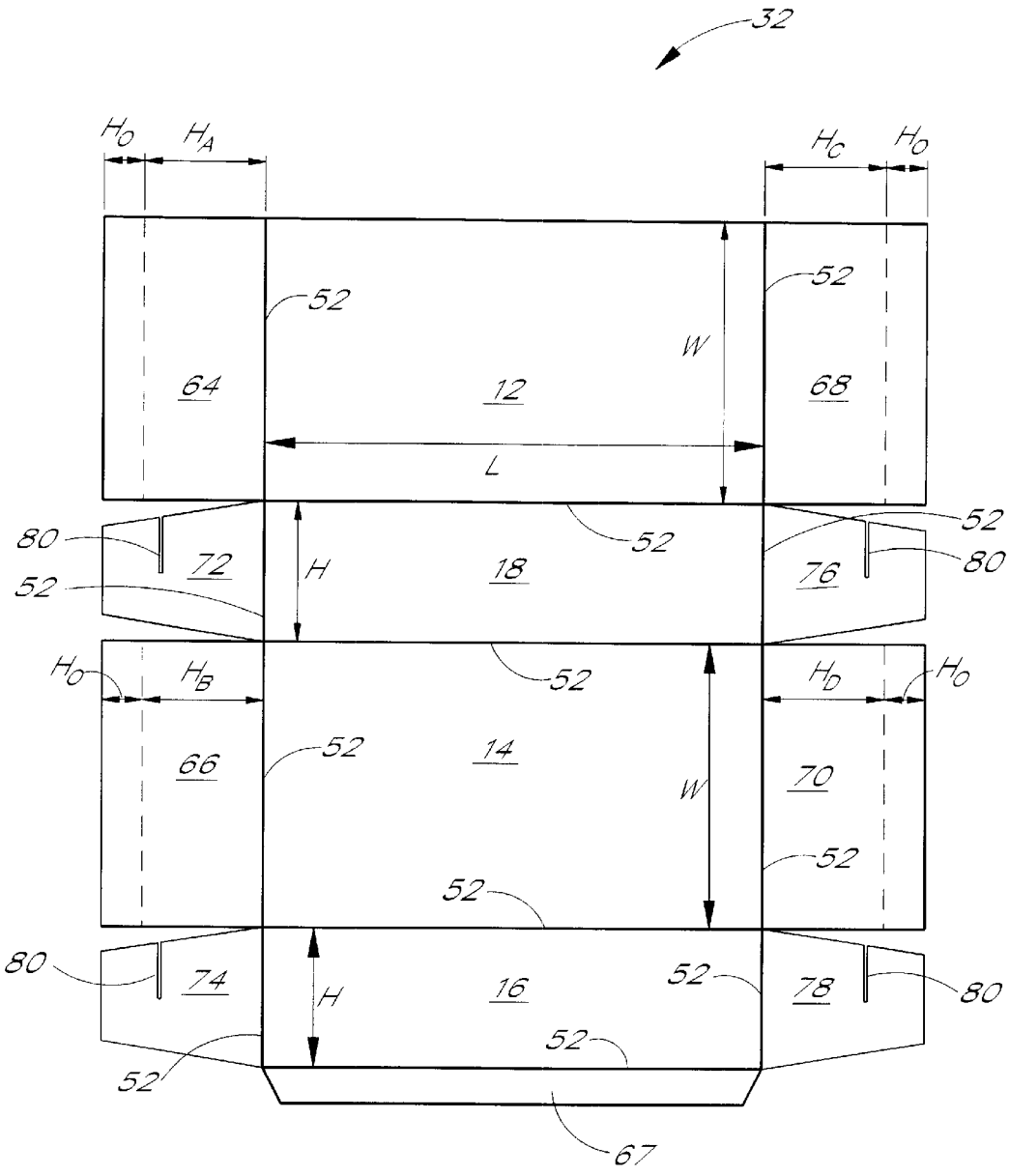
FIG. 3A shows an embodiment of the blank for the file block shown in FIG. 1.
Figure 3B:
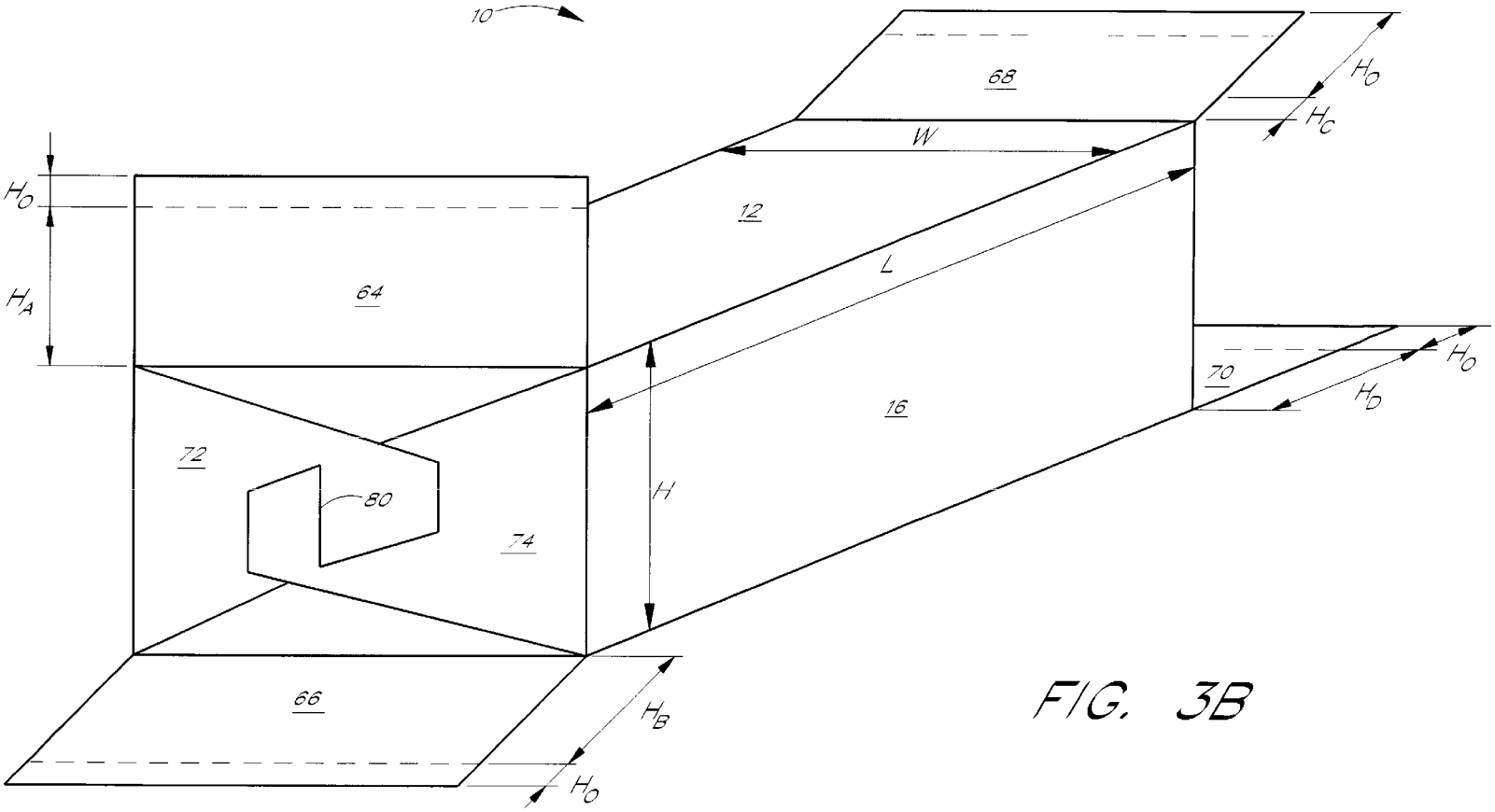
FIG. 3B illustrates the assembly of the blank shown in FIG. 3A.

Another embodiment of the file block blank 32 is shown in FIGS. 3A and 3B. Referring to FIG. 3A, each of the left and right sidewall portions is separated into two portions. A first left sidewall portion 64 depends from the left edge of the top wall portion 12, and a second left sidewall portion 66 depends from the left edge of the bottom wall portion 14. The first and second left sidewall portions 64, 66 connect to each other to form the left sidewall 20 (FIG. 1) of the file block 10 when the blank 32 is assembled. A flange 67 extends from the lower edge of the front wall portion 16 and is attached to an area of the top wall portion 12 to form a rectangular box of the file block 10 while being assembled.

An area of each separate portion 64, 66 overlaps with an overlap lateral length of $H_O$, where they are attached to each other by applying adhesive or stapling. The remaining lateral lengths of the first and second left sidewall portions 64, 66 are respectively referred to as $H_A$ and $H_B$. The overall length $H_L$ of the first and second left sidewall portions 64, 66, when attached to each other, becomes $H_A + H_B + H_O$. The overall length $H_L$ ($=H_A+H_B+H_O$) is greater than the vertical length H of the front and rear sidewall portions 16, 18, which is the height H of the file block 10. This configuration enables the left sidewall 20 of the file block 10 to expand outward. Similar construction is advantageously applied to first and second right sidewall portions 68, 70, as illustrated in the drawing. As discussed above in connection with FIG. 2A, the left and right side walls 20, 22 may sufficiently bow out enough to provide the required resiliency even when the lateral overall length $H_L$ is almost identical to the vertical length.

Along each of the left and right edges of the front and rear sidewall portions 16, 18, four extended portions 72, 74, 76, 78 are provided. Each of the extended portions 72, 74, 76, 78 includes a slit 80, extending from an upper edge thereof. FIG. 3B illustrates a partially assembled blank 32 shown in FIG. 3A. The two extended portions 72, 74, each extending from the left edges of the front and rear sidewall portions 16, 18 engage each other through the slits 80 thereof Although not illustrated, the two extended portions 72, each extending from the right edges of the front and rear sidewall portions 16, 18 engage each other through the slits 74 thereof in the same manner. Alternatively, the extended portions can be secured by applying adhesive, staples, interlocking connections, or other means. The engagement of the two extended portions 72, 74, 76, 78 provides the file block 10 with additional structural rigidity.

Figure 4A:
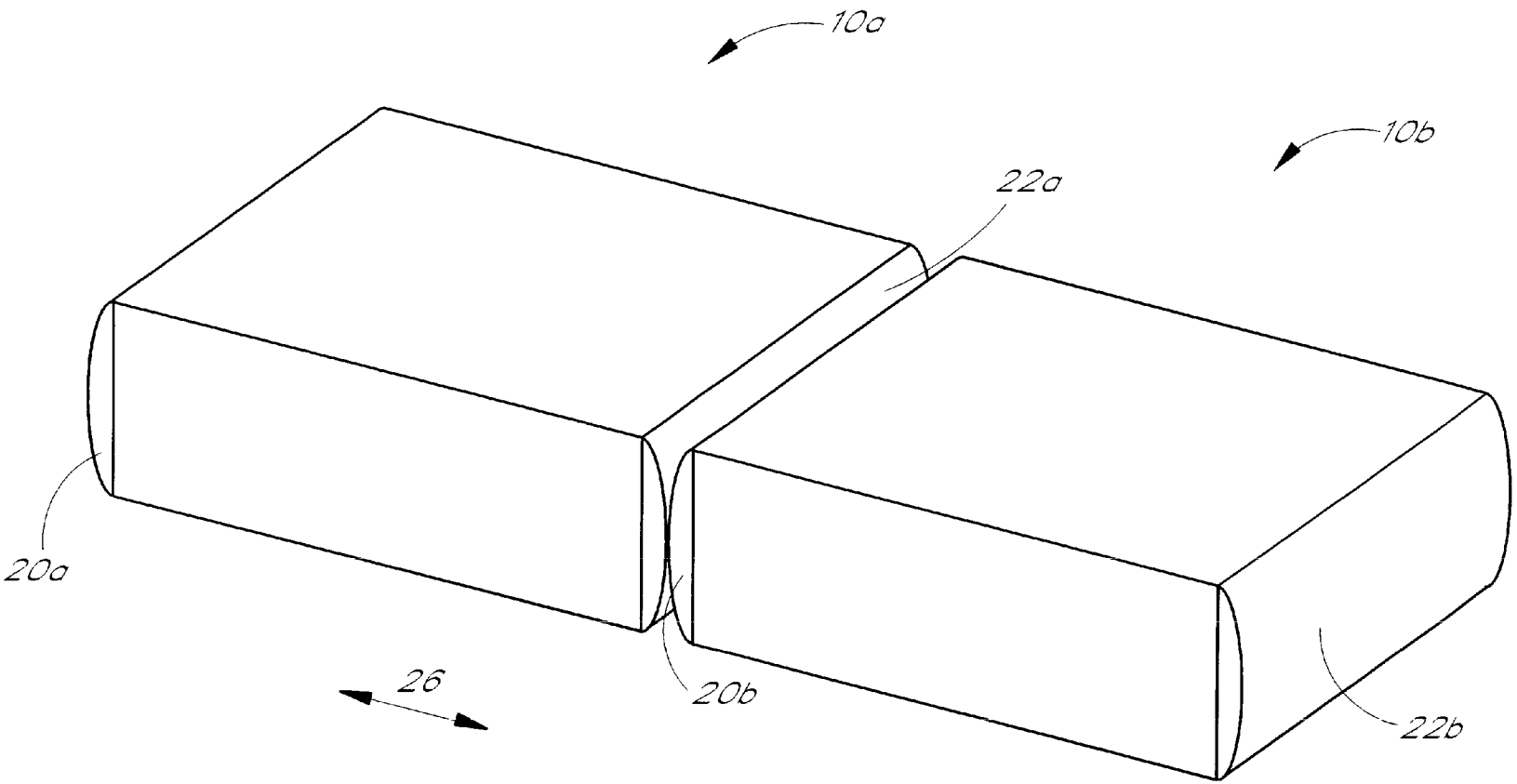
FIG. 4A shows an arrangement of file blocks.
Figure 4B:
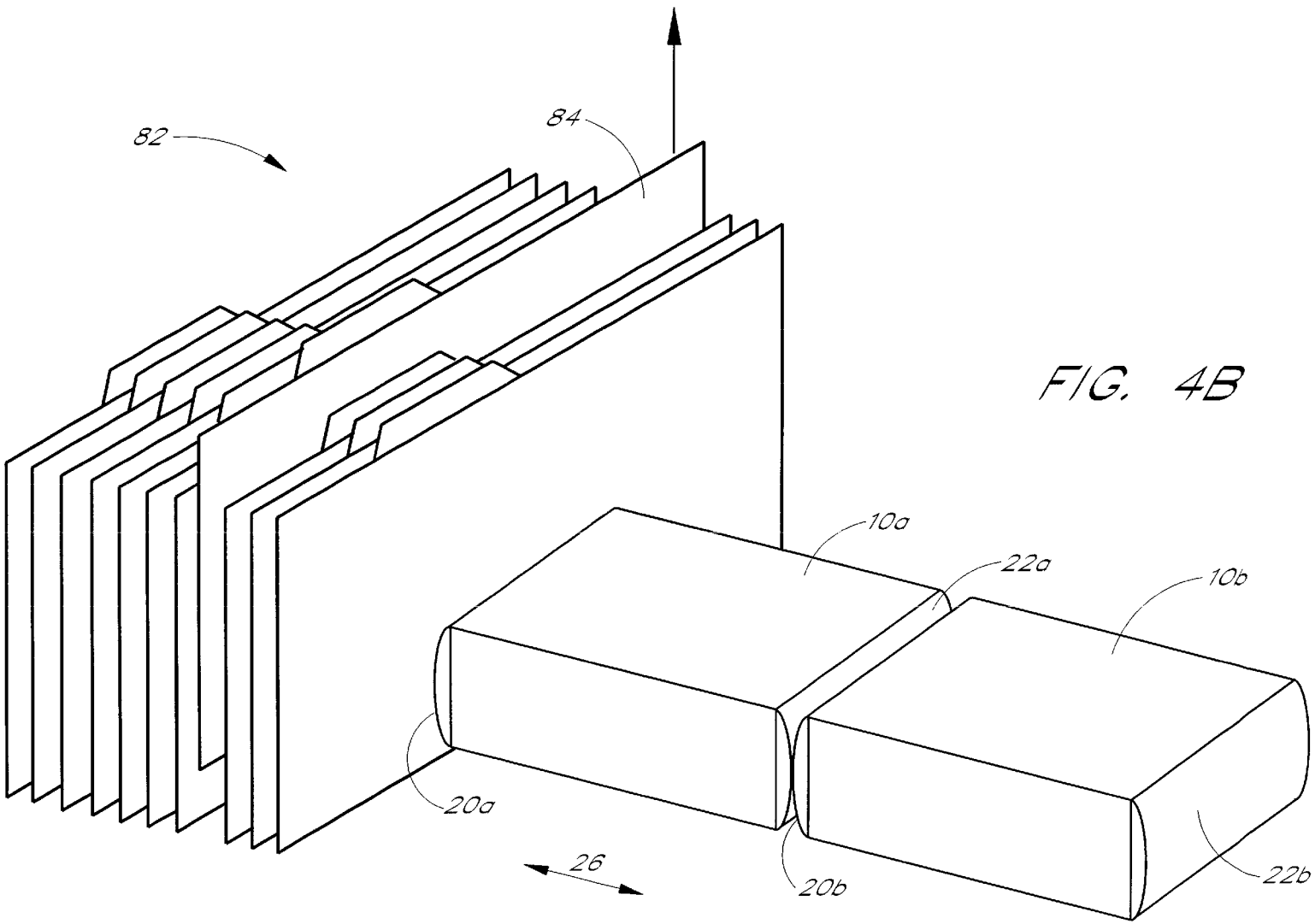
FIG. 4B illustrates a place marker function of the arrangement.

In FIG. 4A, an exemplary use of a couple of the file blocks 10 of FIG. 1 is illustrated. Two file blocks 10*a*, 10*b*, each of which has two opposingly located curved walls 20*a*, 22*a*, 20*b*, 22*b*, lie in series with one curved wall 22*a* of one file block 10*a* contacting one curved wall 20*b* of the other file block 10*b*. The two remaining curved walls 20*a*, 22*b* away from each other support either file folders (not shown), or inner wall of the drawer (not shown). With this arrangement, the file blocks 10*a*, 10*b* provide higher pressure than a single file block 10 along the axis through the curved walls 20*a*, 22*a*, 20*b*, 22*b* against the inner wall of the drawer and the file folders to be supported. If the space within the file drawer or container allows, more than two file blocks 10 can be arranged in series.

Figure 6A:
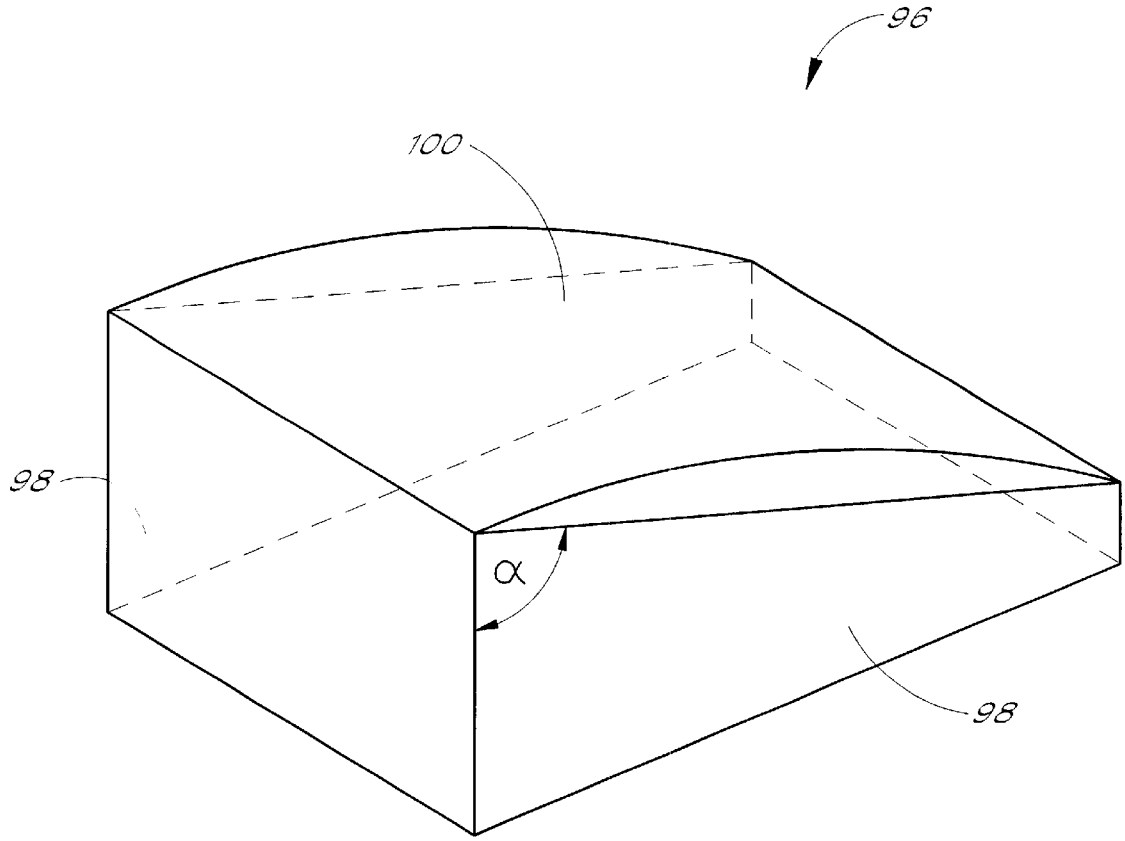
FIGS. 6A and 6B respectively illustrate another embodiment of the file block and an exemplary use thereof.
Figure 6B:
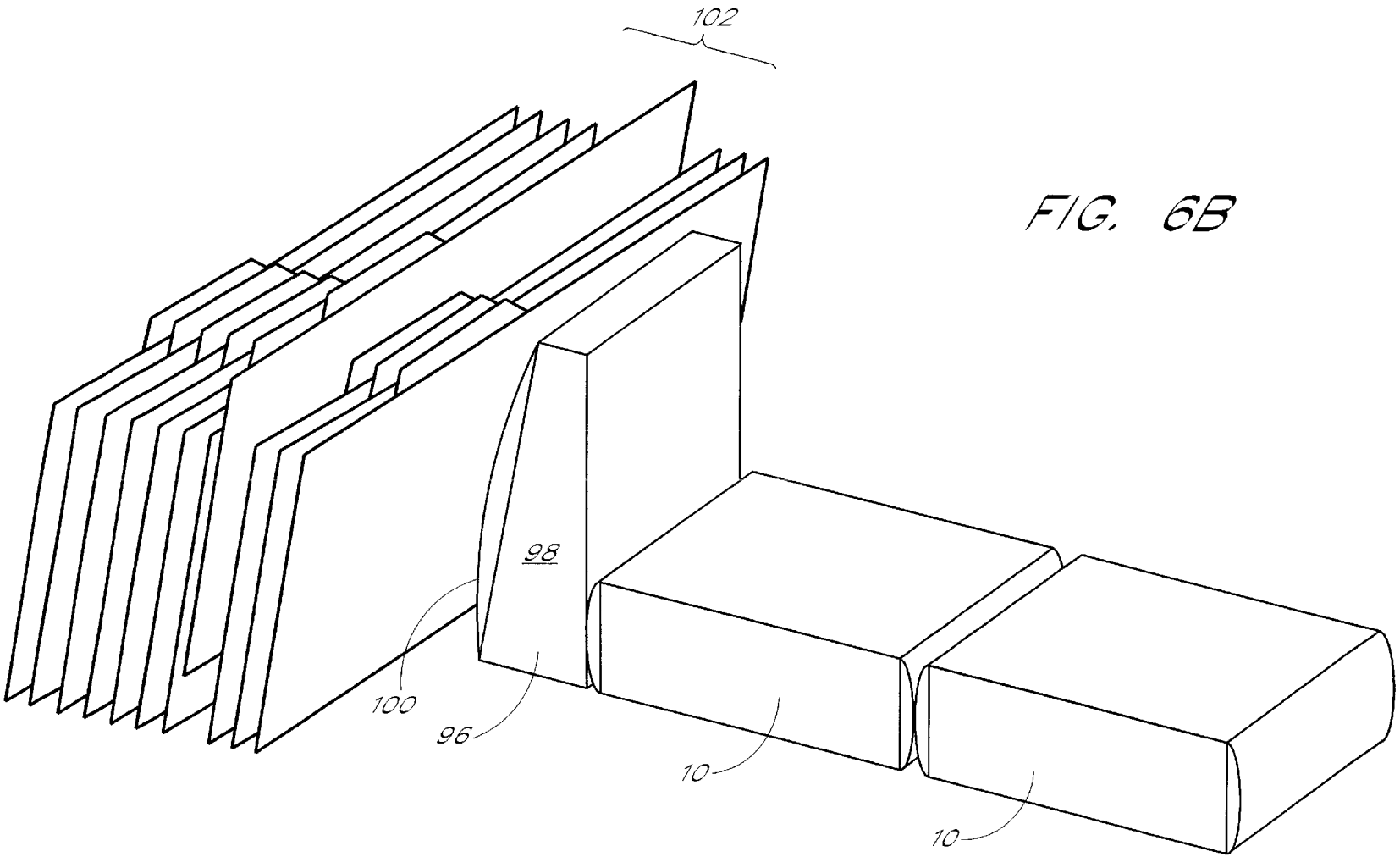

FIG. 6B illustrates a place marker function of the file blocks 10. If sufficient pressure against file folders 82 is maintained, when a specific file is retrieved from the pile, one or more file folders 84 adjacent to the retrieved file can be slightly elevated. The elevated files 84 remain in the elevated position due to the pressure of the file block against the file folders 82, and acts as a place marker for the retrieved file.

Figure 5A:
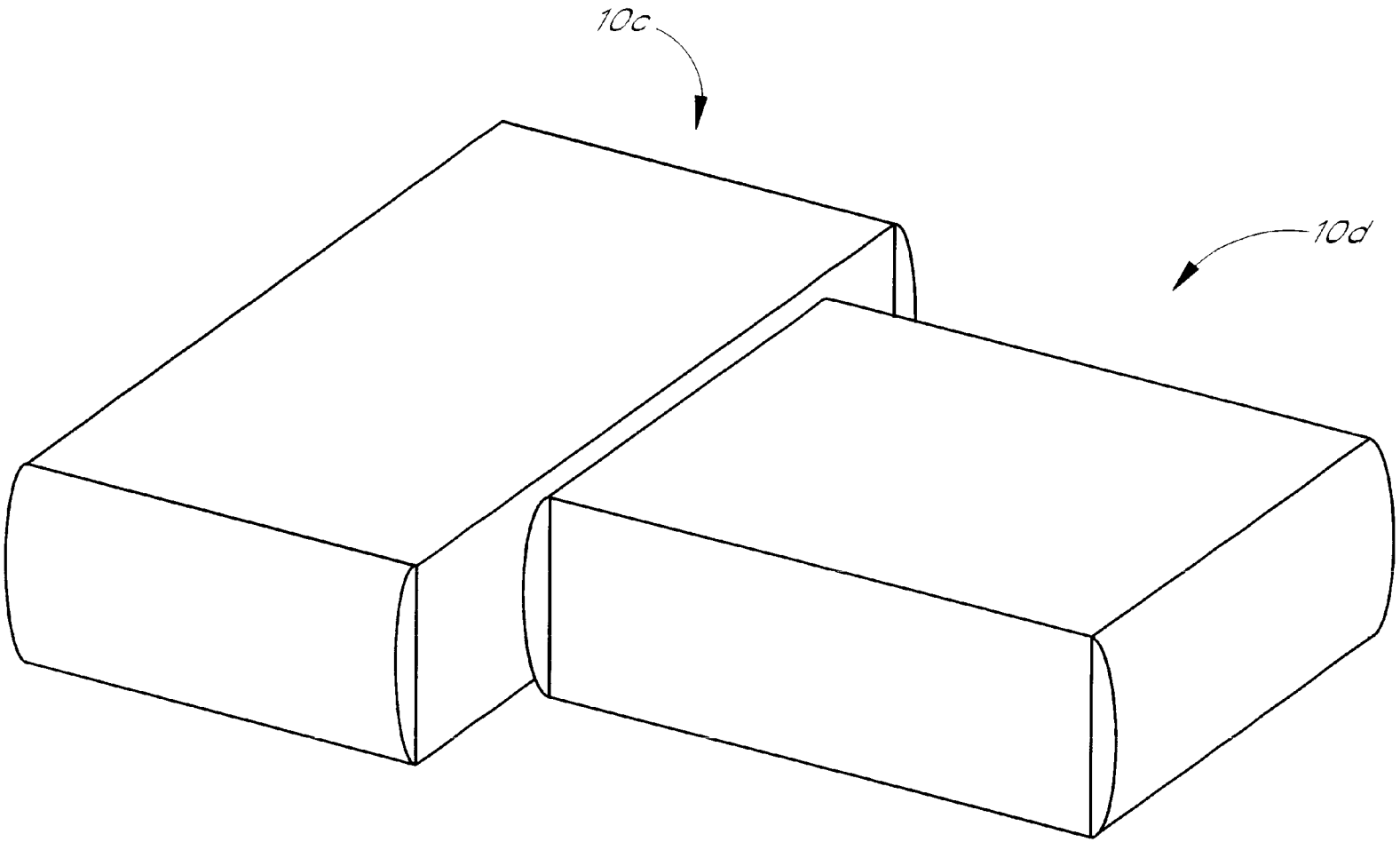
FIGS. 5A and 5B illustrate additional arrangements of a plurality of the file blocks.
Figure 5B:
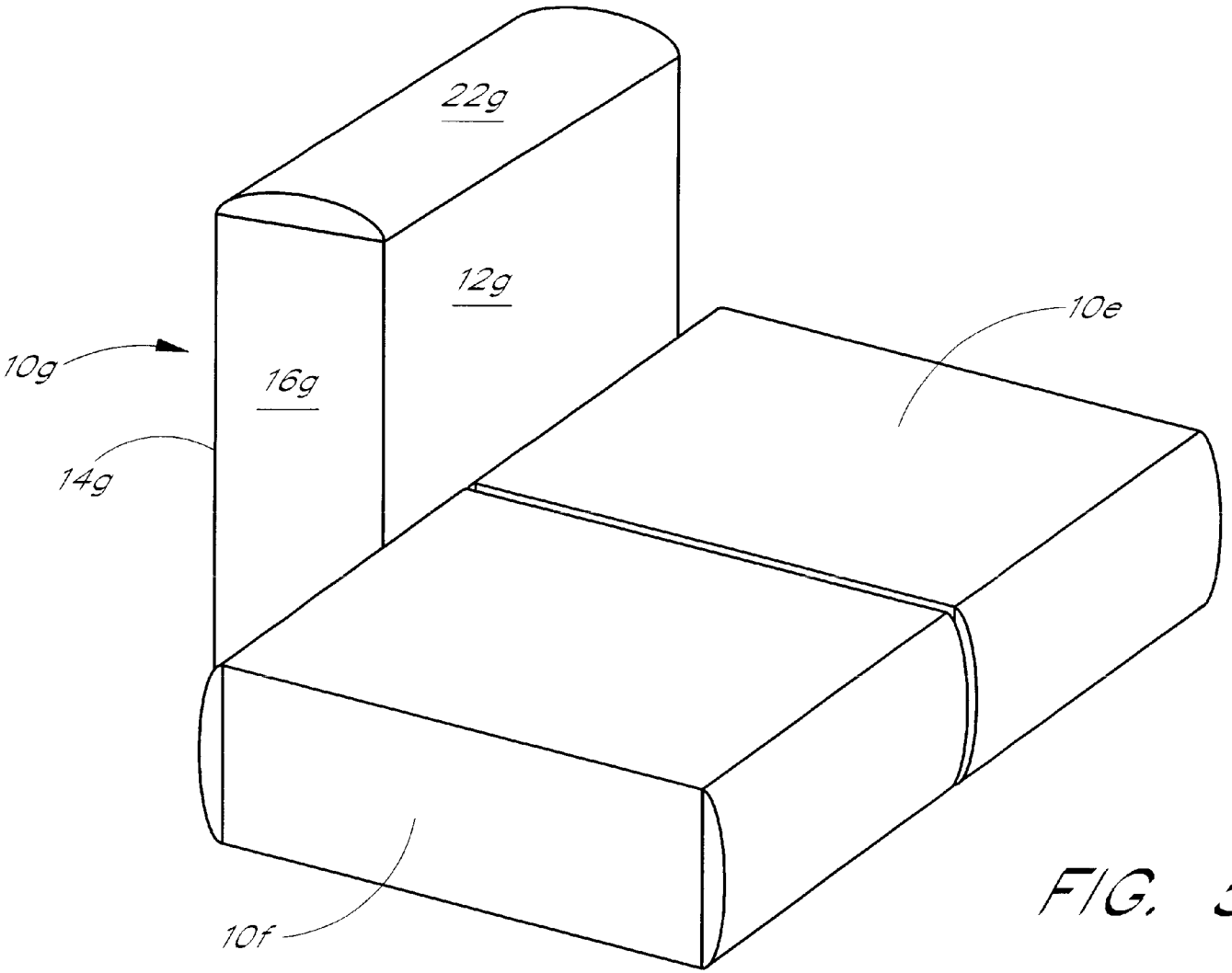

FIGS. 5A and 5B illustrates additional exemplary uses of a plurality of the file blocks 10, in which file folders or the like supported by the file block and the drawers or container enclosing them are not shown for simplicity of the illustration Referring to FIG. 5A, one file block 10*c* lies perpendicular to another file block 10*d* in terms of their longitudinal directions. This arrangement is sometimes required when the space within the drawer or container is not enough to arrange the two file blocks 10*c*, 10*d* in series but requires more than one file block. In FIG. 5B, two file blocks 10*e*, 10*f* lie in parallel, and one additional file block 10*g* stands beside the two file blocks 10*e*, 10*f*. With this arrangement, the standing file block 10*g* supports generally bigger file folders or the like with its top or bottom wall 14*g* than its other sidewalls 16*g*, 22*g*. Although not illustrated, numerous variations of the arrangement are available in accordance with the present invention.

Each file block can be oriented as needed to best fill the empty space in a file drawer or container in order to restrain movement of the files suspended in the file drawer or container. One block 10 may be sufficient when positioned with its length, width, or height against the file drawer or container. As needed, additional blocks 10, in various orientations and combinations of orientations, can be used.

Referring to FIGS. 6A and 6B, illustrated are an additional embodiment of the file block and an exemplary use thereof.

The file block 96 shown in FIG. 6A has an inclined wall which can take the form of a triangular shape, but preferably has a trapezoidal shape formed by a pair of opposingly located trapezoidal walls 98, each of which has a slanted edge with an acute angle a between neighboring edges. With the trapezoidal walls 98, the file block 96 can have an inclined surface 100, which is also resiliently urged outward in the same way as discussed above with regard to the rectangular file block 10. The inclined surface 100 allows the abutting file folders 102 slanted along the inclined surface 100, as illustrated in FIG. 6B. This enables convenient visual access to the index tabs and/or the contents of the folders 102. The surface opposing the inclined surface is orthogonal to the ends so that it abuts an adjacent block 10. The ends of the trapezoidal block are preferably wide enough to abut and cooperate with the ends of other file blocks in the event the inclined wall is placed vertically upward so it does not contact the files folders 102. This increases the flexibility to use the block. Although not illustrated, other polygonal walls resulting in an inclined surface, such as right triangular walls, can substitute for the trapezoidal walls 98. Advantageously though, there is one orthogonal wall to abut fully against an adjacent file block, and one inclined wall to abut the files or folders 102. Preferably, the ends of the block are sufficiently wide to abut and cooperate with the ends of other file blocks in different orientations of the blocks, as needed.

The trapezoidal walls 98 may have more than one slanted edge. The acute angle $\alpha$ between neighboring edges of the trapezoid 98 is advantageously larger than about 60°, desirably about 65° to about 75°, and preferably about 70°. The file block may have more than one pair of the trapezoidal or polygonal walls 98. The file block 96 with the slanted surface 100 can be used in combination with other file blocks 10 to create an angled support for file folders, as illustrated in FIG. 6B, advantageously with one perpendicular side to abut adjoining blocks 10, and an opposing inclined side to abut files folders.

Figure 7:
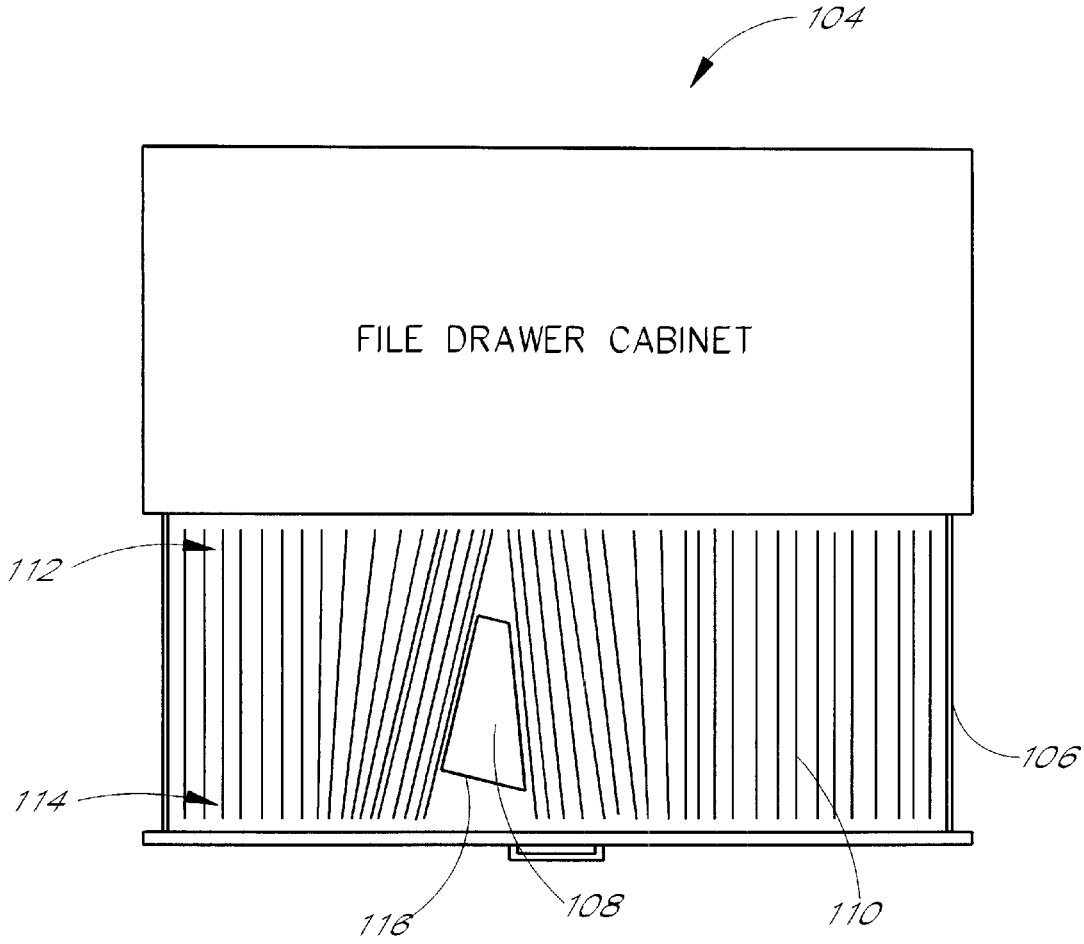
FIG. 7 illustrates a use of the file block as a stabilizer in connection with a lateral file cabinet drawer.

FIG. 7 illustrates a top view of a file drawer cabinet 104 with a fully loaded file drawer 106 pulled out. A trapezoidal file block 108 having two slanted edges in its trapezoidal walls is inserted between file folders 110 loaded in the drawer 106. Although not illustrated in detail, usually, file folders 110 are thicker at one end 112 because it houses fasteners and/or staples. Conversely, the opposite end 114 of the file folders 110 is thinner. Thus, file folders 110 even in a fully loaded drawer or a container 104 tend to fit more loosely at one end 114. This can be effectively stabilized by inserting at least one trapezoidal file block 108 between the file folders 110. The orientation can be selected to vary the file orientation. For example, a trapezoidal file block 108 could be inserted with the wide end at the bottom of the container, with the wide end at the top of the container, or with the wide end at one side of the container—depending on the material within the folders or depending on what portion of the files is desired to be compacted or expanded.

Advantageously the trapezoidal file block 108 is inserted with its acute angle side 116 toward the loosely fit end 114 of the file folders 110. The rectangular file block 10 can also be used in stabilizing the file folders 110 in such a fully loaded drawer 106 by itself or in combination with the trapezoidal file block 108. Moreover, although not illustrated, one or more file blocks 10, 108 can be used alone, or in combination, to keep groups of files separated.

The present invention provides a simple structure and thus an inexpensive file block 10, 108 for supporting files folders and the like. As the file block is easily assembled from a blank, it can be stored, transported, or marketed before assembling, which reduces the space required therefor. The file block effectively supports file folders or fills an empty space by itself or in combination with one or more other file blocks.

As described, appropriate walls of the file block are resiliently urged outward by making one wall longer than the space between mating walls. It is possible to insert a resilient material, such as sponge or foam behind a wall and an underlying structure to further resiliently urge the wall outward. For example, a resilient material interposed between a wall and the underlying structure thereof could form a resilient, outwardly urged surface.

The file blocks are preferably empty. But, the file block can also be used as a storage device for various small items if it is assembled in the way in which at least one wall can open. Further, the walls of the box provide a surface for advertising media, on which a promotional materials or labels can be imprinted or placed.

With the use of the file blocks, file folders rest directly on the bottom surface of the file drawer or container, in contrast to the case of hanging type file supporters. No space is wasted under the file folders, and the entire vertical space of any given storage unit is used in the most efficient manner. Further, the possibility of index tab damage can be eliminated.

There is thus provided a method of supporting and maintaining the vertical and internal positions of file folders in a storage container such as a file drawer, file box, storage bin, etc. The different dimensions of the file blocks can be orientated combined and orientated to support a plurality of folders in various orientations and locations in the container. The file blocks can be inserted between files to create a slight vertical angle of the folders in a storage container to increase the visual access. The file blocks can be used to create a place market for easy location and insertion of removed files. Printed indicia such as advertising, instructional, safety or other media can be placed on the file blocks. When the file blocks are hollow, they provide a convenient storage location for small articles that would otherwise get lost in a storage container. Because the file blocks can be packaged and shipped flat, they provide an easily transportable means of orientating and positioning the files, that can be produced and shipped at an advantageous cost. Finally, while the file blocks are described as supporting and positioning file folders, the file blocks can be used with other objects or items to be stored.

Although the present invention has been described in terms of embodiments, other embodiments will become apparent to those of ordinary skill in the art, in view of the disclosure herein. Accordingly, the present invention is not to be limited by the recitation of the embodiments, but should be broadly construed to encompass reasonable variations of the method and apparatus disclosed herein.

What is claimed is:

1. A method for supporting objects in a walled storage container where the container has a predetermined length, width and height, with the width less than the length, comprising the steps of:

placing at least one file block in the container and positioning the file block so that the file block has a first surface abutting one of the objects and an opposing surface abutting a supporting surface comprising one of a wall of the container or another one of the objects in the container, wherein the at least one file block has six substantially quadrilateral walls at least one of which is of a different size than the other walls and the longest wall is shorter than the width of the container, the file block being selected of material sufficient to make each file block self supporting in all orientations so the file block can be placed in various orientations in two orthogonal planes during use with the orientation of the file block being selected to achieve the placing step, the walls defining an enclosed space with at least one of the walls configured to be opened so the enclosed space can store items.

2. A method as defined in claim 1, comprising the step of providing the file block with at least one surface that is resiliently urged outward from the file block.

3. A method as defined in claim 1, comprising the step of placing at least two file blocks in the container and in contact with each other and selecting one of the file blocks to have an inclined wall relative to an opposing wall.

4. The method of claim 1, comprising the further step of adjusting the spacing between objects in the container by placing two file blocks in the container in contact with each other, each with a different orientation.

5. A method for supporting files in a walled storage container, the container having a predetermined length, width and height, the method comprising the steps of:

providing at least one polyhedral file block comprising a plurality of walls connected to define a shape, the longest wall of the block being shorter than the width of the container, wherein the at least one polyhedral file block is provided such that at least two opposing walls of the file block incline toward each other and with the walls defining an enclosed space having walls on all sides of the space, with at least one wall configured to be opened so that the enclosed space can store small various items;

placing files within the container; and placing the at least one file block in the container such that one wall of the file block abuts the files and such that an opposing wall of the file block abuts a supporting surface comprising one of the walls of the container, another file or another file block in the container.

6. The method as defined in claim 5, wherein the at least one file block abutting the files and the supporting surface exerts pressure onto the files so that adjacent files can contact each other.

7. The method as defined in claim 6, wherein the at least one file block abutting the files and the supporting surface exerts pressure onto the files, whereby when a file is elevated, the file is kept elevated by the pressure.

8. The method as defined in claim 5, wherein the file block comprises at least one surface that is resiliently urged outward from the file block.

9. The method as defined in claim 5, wherein the files contained within the container contact a bottom wall of the container.

10. The method as defined in claim 5, wherein the step of placing the files comprises placing the files along the length of the container.

11. The method as defined in claim 5, wherein the step of placing the files comprises placing the files along the width of the container.

12. The method as defined in claim 11, wherein the files are placed such that at least two columns of files are stacked parallel to each other in said storage container.

13. The method of claim 11, comprising the further step of providing at least a second file block in the container placed in contact with and cooperating with the at least one file block to support files within the container.

14. The method as defined in claim 5, wherein the file block is hexahedral.

15. The method as defined in claim 14, wherein the hexahedral file block comprises six substantially quadrilateral walls.

16. The method as defined in claim 5, wherein the polyhedral file block is provided such that at least two opposing walls of the file block are parallel to each other.

17. The method as defined in claim 5, wherein the file block is wedge-shaped.

18. The method as defined in claim 17, wherein the wedge-shaped file block is hexahedral or pentahedral, wherein the hexahedral file block comprises six substantially quadrilateral walls, and the pentahedral file block comprises three substantially quadrilateral walls and two triangular walls.

19. The method as defined in claim 17, wherein the wedge-shaped file block is inserted between two neighboring files so that the file block exerts pressure on both neighboring files and exerts sufficient pressure to stabilize the files which are tilted.

20. The method of claim 5, comprising the further step of providing at least a second file block in the container placed in contact with and cooperating with the at least one file block to support files within the container.

21. The method of claim 5, comprising the further step of adjusting the spacing between files in the container by adjusting the orientation of two file blocks in the container, with the file blocks being in contact with each other.

22. A method for supporting files in a walled storage container, the container having a predetermined length, width and height, the method comprising the steps of:

providing at least one polyhedral file block comprising a plurality of walls joined to form at least a three sided, closed shape in which the walls are not adapted to change position relative to each other during use, the longest wall of the block being shorter than the width of the container, wherein the walls define an enclosed space with one of the walls being configured to open so that the enclosed space can store various items;

placing files within the container; and placing the at least one file block in the container such that one wall of the file block abuts one of the files and such that an opposing wall of the file block abuts a supporting surface comprising one of the walls of the container, another file or another file block in the container.

23. The method of claim 22, comprising the further step of providing at least a second file block in the container placed in contact with and cooperating with the at least one file block to support files within the container.

24. The method of claim 22, comprising the further step of adjusting the spacing between files in the container by adjusting the orientation of two file blocks in the container, with the file blocks being in contact with each other.

25. A method for supporting files in a walled storage container, the container having a predetermined length, width and height, the method comprising:

providing at least one polyhedral file block comprising a plurality of walls the longest wall of the block being shorter than the width of the container, wherein the walls of the at least one polyhedral file block define an enclosed space with at least one wall configured to be opened so that the enclosed space can store various small items;

placing files within the container; and placing the at least one file block in the container such that one wall of the file block abuts the files and such that an opposing wall of the file block abuts a supporting surface comprising one of the walls of the container, another file or another file block in the container.

26. The method of claim 25, further comprising providing the file block with at least two opposing walls that are inclined toward each other.

27. The method of claim 25, wherein each of the walls form a quadrilateral.

28. The method of claim 25, wherein the file block has six walls, at least four of which are quadrilateral.

29. The method of claim 28, wherein the walls of the at least one file block are connected to define a fixed shape that does not vary.

30. The method of claim 25, comprising providing at least a second file block in the container placed in contact with and cooperating with the at least one file block in order to support files within the container.

31. The method of claim 25, comprising the further step of adjusting the spacing between files in the container by placing two file blocks in the container in contact with each other, each file block having a different orientation.

32. The method of claim 25, comprising the step of adjusting the spacing between files in the container by adjusting the orientation of two file blocks in the container, with the file blocks being in contact with each other.

* * * * *